US008395513B2

(12) United States Patent
Moran et al.

(10) Patent No.: US 8,395,513 B2
(45) Date of Patent: Mar. 12, 2013

(54) TECHNIQUE FOR DETECTING TRACKING DEVICE TAMPERING USING AN AUXILIARY DEVICE

(75) Inventors: Brian Sean Moran, Reston, VA (US); David William LeJeune, Jr., Reston, VA (US)

(73) Assignee: Satellite Tracking of People LLP, Houston, TX (US)

( * ) Notice: Subject to any disclaimer, the term of this patent is extended or adjusted under 35 U.S.C. 154(b) by 418 days.

(21) Appl. No.: 12/576,090

(22) Filed: Oct. 8, 2009

(65) Prior Publication Data

US 2010/0090826 A1 Apr. 15, 2010

Related U.S. Application Data

(60) Provisional application No. 61/104,576, filed on Oct. 10, 2008.

(51) Int. Cl.
*G08B 23/00* (2006.01)

(52) U.S. Cl. ..... 340/573.4; 340/539.13; 455/456.1

(58) Field of Classification Search ..... 340/539.11–539.13, 573.1, 573.4, 340/572.1, 572.4, 539.31; 455/456.1, 456.5, 455/457, 404.1, 404.2; 379/37, 38, 45
See application file for complete search history.

(56) References Cited

U.S. PATENT DOCUMENTS

| | | | |
|---|---|---|---|
| 4,359,733 | A | 11/1982 | O'Neill |
| 4,656,463 | A | 4/1987 | Anders et al. |
| 4,673,936 | A | 6/1987 | Kotoh |
| 4,741,245 | A | 5/1988 | Malone |
| 4,747,120 | A | 5/1988 | Foley |
| 4,812,823 | A | 3/1989 | Dickerson |
| 4,819,053 | A | 4/1989 | Halavais |
| 4,819,860 | A | 4/1989 | Hargrove et al. |
| 4,885,571 | A | 12/1989 | Pauley et al. |
| 4,918,432 | A | 4/1990 | Pauley et al. |
| 4,952,928 | A | 8/1990 | Carroll et al. |

(Continued)

FOREIGN PATENT DOCUMENTS

WO WO-0077688 A1 12/2000

OTHER PUBLICATIONS

B.L. Huskey, "Electronic Monitoring: An Evolving Alternative," Perspective, Summer 1987, pp. 19-23.

(Continued)

*Primary Examiner* — Thomas Mullen
(74) *Attorney, Agent, or Firm* — Novak Druce Connolly Bove + Quigg LLP

(57) ABSTRACT

A technique is disclosed for detecting the presence of a certain form of tampering with respect to the operation of a tracking device. The tracking device is of the kind that receives signals from which the location of the tracking device is determined and the tampering that is detected is of the kind wherein signal shielding material is intentionally placed around the tracking device so as to interfere with its ability to receive these signals. In accordance with the present invention, an auxiliary device transmits a signal that mimics certain characteristics of the signal received by the tracking device and from which the location of the tracking device is determined. The auxiliary device is disposed close to the tracking device so that the tracking device is able to receive the mimicking signal from the auxiliary device even when the tracking device is disposed in a location wherein the ability of the tracking device's to receive its location-determining signal is poor or nonexistent. The signal transmitted by the auxiliary device is received at the tracking device and is then processed at such device or at another location to detect whether or not there has been tampering of the type described hereinabove. This processing of the auxiliary device signal may be alone or in combination with other signals received by the tracking device.

24 Claims, 4 Drawing Sheets

U.S. PATENT DOCUMENTS

| | | | | | |
|---|---|---|---|---|---|
| 4,999,613 | A | | 3/1991 | Williamson et al. | |
| 5,019,828 | A | | 5/1991 | Schoolman | |
| 5,043,736 | A | | 8/1991 | Darnell et al. | |
| 5,146,231 | A | | 9/1992 | Ghaem et al. | |
| 5,223,844 | A | | 6/1993 | Mansell et al. | |
| 5,266,958 | A | | 11/1993 | Durboraw, III | |
| 5,298,884 | A | | 3/1994 | Gilmore et al. | |
| 5,317,309 | A | | 5/1994 | Vercellotti et al. | |
| 5,334,974 | A | | 8/1994 | Simms et al. | |
| 5,392,052 | A | | 2/1995 | Eberwine | |
| 5,396,227 | A | | 3/1995 | Carroll et al. | |
| 5,416,468 | A | | 5/1995 | Baumann | |
| 5,416,695 | A | | 5/1995 | Stutman et al. | |
| 5,418,537 | A | | 5/1995 | Bird | |
| 5,437,278 | A | | 8/1995 | Wilk | |
| 5,461,365 | A | | 10/1995 | Schlager et al. | |
| 5,461,390 | A | | 10/1995 | Hoshen | |
| 5,493,694 | A | | 2/1996 | Vlcek et al. | |
| 5,497,149 | A | | 3/1996 | Fast | |
| 5,523,740 | A | | 6/1996 | Burgmann | |
| 5,528,248 | A | | 6/1996 | Steiner et al. | |
| 5,537,102 | A | | 7/1996 | Pinnow | |
| 5,541,845 | A | | 7/1996 | Klein | |
| 5,544,661 | A | | 8/1996 | Davis et al. | |
| 5,552,772 | A | | 9/1996 | Janky et al. | |
| 5,559,497 | A | | 9/1996 | Hong | |
| 5,568,119 | A | | 10/1996 | Schipper et al. | |
| 5,594,425 | A | | 1/1997 | Ladner et al. | |
| 5,627,548 | A | | 5/1997 | Woo et al. | |
| 5,652,570 | A | * | 7/1997 | Lepkofker | 340/573.4 |
| 5,731,757 | A | * | 3/1998 | Layson, Jr. | 340/573.1 |
| 5,742,233 | A | | 4/1998 | Hoffman et al. | |
| 5,748,148 | A | | 5/1998 | Heiser et al. | |
| 5,825,283 | A | | 10/1998 | Camhi | |
| 5,825,871 | A | | 10/1998 | Mark | |
| 5,857,433 | A | | 1/1999 | Files | |
| 5,868,100 | A | | 2/1999 | Marsh | |
| 5,889,474 | A | | 3/1999 | LaDue | |
| 5,892,447 | A | | 4/1999 | Wilkinson | |
| 5,892,454 | A | | 4/1999 | Schipper et al. | |
| 5,905,461 | A | | 5/1999 | Neher | |
| 5,912,623 | A | | 6/1999 | Pierson | |
| 5,919,239 | A | | 7/1999 | Fraker et al. | |
| 5,936,529 | A | | 8/1999 | Reisman et al. | |
| 5,959,533 | A | | 9/1999 | Layson, Jr. et al. | |
| 5,963,130 | A | | 10/1999 | Schlager et al. | |
| 5,982,281 | A | | 11/1999 | Layson, Jr. | |
| 5,990,793 | A | | 11/1999 | Bieback | |
| 6,014,080 | A | | 1/2000 | Layson, Jr. | |
| 6,031,454 | A | | 2/2000 | Lovejoy et al. | |
| 6,054,928 | A | | 4/2000 | Lemelson et al. | |
| 6,072,396 | A | | 6/2000 | Gaukel | |
| 6,100,806 | A | * | 8/2000 | Gaukel | 340/573.4 |
| 6,130,620 | A | | 10/2000 | Pinnow et al. | |
| 6,160,481 | A | * | 12/2000 | Taylor, Jr. | 340/573.4 |
| 6,181,253 | B1 | | 1/2001 | Eschenbach et al. | |
| 6,198,394 | B1 | | 3/2001 | Jacobsen et al. | |
| 6,232,916 | B1 | | 5/2001 | Grillo et al. | |
| 6,236,319 | B1 | | 5/2001 | Pitzer et al. | |
| 6,239,700 | B1 | | 5/2001 | Hoffman et al. | |
| 6,239,743 | B1 | | 5/2001 | Lennen | |
| 6,262,666 | B1 | | 7/2001 | Lodichand | |
| 6,405,213 | B1 | | 6/2002 | Layson et al. | |
| 6,774,797 | B2 | * | 8/2004 | Freathy et al. | 340/573.1 |
| RE38,838 | E | | 10/2005 | Taylor, Jr. | |
| RE39,909 | E | | 11/2007 | Taylor, Jr. | |
| 2004/0203461 | A1 | | 10/2004 | Hay | |
| 2005/0040944 | A1 | * | 2/2005 | Contestabile | 340/539.13 |
| 2008/0316022 | A1 | | 12/2008 | Buck et al. | |
| 2009/0104869 | A1 | | 4/2009 | Li | |
| 2009/0186596 | A1 | | 7/2009 | Kaltsukis | |

OTHER PUBLICATIONS

M. Alexander et al., "An Automated System for the Identification and Prioritization of Rape Suspects," SDSS for Rape Suspect Identification, http://www.esri.com/library/userconf/proc97/proc97/to350/pap333.htm, Jul. 2001.

M.T. Charles, "The Development of a Juvenile Electronic Monitoring Program," Federal Probation, Jun. 1989, vol. III, pp. 3-12.

D. Anderson, "Seattle and Tacoma PDs Automated Crime Analysis," The Journal, National FOP, Spring 1990.

R. Block, "Geocoding of Crime Incidents Using the 1990 TIGER File: The Chicago Example," Loyola University, Chicago, Chapter 15, pp. 189-193.

G. W. Brown, Jr., "What impact will personal position location technology have upon the management and administration of mid-sized law enforcement organizations by the year 2000?", California Commission on Peace Officer Standards and Training, Sacramento, California, Jul. 1994.

B. Clede, "Radio computers locate places, and plot them on a map, too", Law and Order, Oct. 1994, http://www.clede.com/Articles/Police/gps.htm.

DLA Piper, John Guaragna, Appendix B, Defendants' Joint Invalidity Contentions, Mar. 31, 2009.

B. Wise, "Catching Crooks With Computers," American City & County, May 1995, pp. 54-62.

L. Pilant, "Spotlight on . . . High-Technology Solutions," From Police Chief, International Association of Chiefs of Police, Document #54650, May 1996.

M. Anderson (editor), "GPS Used to Track Criminals," GIS World, Aug. 1996, p. 15.

A.W. Cohn et al., "The Evaluation of Electronic Monitoring Programs," Perspectives, Fall 1996, pp. 28-37.

D. Evans, "Electronic Monitoring: Testimony to Ontario's Standing Committee on Administration of Justice," Perspectives, Fall 1996, pp. 8-10.

American Probation and Parole Association, "Electronic Monitoring," 1996, http://www.appa-net.org/about%20appa/electron.htm.

M. Lyew, "A new weapon for fighting crime" (date unknown).

Albert et al., "GIS/GPS in Law Enforcement Master Bibliography." Nov. 2000.

J. Hoshen et al., "keeping Tabs on Criminals," Spectrum, The Institute of Electrical and Electronics Engineers, Inc., Feb. 1995, pp. 26-32.

John H. Murphy et al., "Advanced Electronic Monitoring for Tracking Persons on Probation or Parole: Final Report," Grumman STC. (publication status unclear; alleged by third parties to be published Feb. 1996).

Hoyt Layson, "Pro Tech Monitoring, Inc. SMART System Briefing," presentation to potential customers and vendors (publication status unclear; alleged by third parties to be presented 1995-1996).

Hoyt Layson, "Current Electronic Monitoring Market Place," presentation to potential customers and vendors (publication status unclear; alleged by third parties to be presented 1995-1996).

Order Granting Request for Ex Parte Reexamination of RE 39,909, U.S. Appl. No. 90/010,372, dated Feb. 17, 2009.

J. Hoshen, et al., "Keeping Tabs on Criminals," Feb. 1995, IEEE Spectrum.

John H. Murphy et al., "Advanced Electronic Monitoring for Tracking Persons on Probation or Parole: Final Report," Grumman STC.

Hoyt Layson, "Pro Tech Monitoring, Inc. SMART System Briefing," presentation to potential customers and vendors, 1995-1996.

Hoyt Layson, "Current Electronic Monitoring Market Place," presentation to potential customers and vendors, 1995-1996.

Jannetta et al., "Report on teh Results of the CDCR Two-Piece GPS System Field Test," Oct. 31, 2007, UC Irvine Center for Evidence-Based Corrections.

Letter from State of New York Executive Department, Divison of Parole, dated Dec. 27, 2012.

Oklahoma Board of Corrections Meeting Minutes, Union City Community Corrections Center, Union City, Oklahoma, Jan. 22, 2009.

Elmo-Tech, Inc., Proposal for Electronic Monitoring Services for State of West Virginia, Sep. 20, 2007.

*Satellite Tracking of People, LLC et al.* v. *Pro Tech Monitoring, Inc. et al.*, "Defendants' Reply Memorandum in Support of Their Motion to Amend Their P.R. 3-3- Invalidity Contentions," pp. 3-4, Oct. 1, 2009.

*Satellite Tracking of People, LLC et al.* v. *Pro Tech Monitoring, Inc. et al.*, "Plaintiffs' Memorandum of Points and Authorities in Opposition to Defendants' Motion for Leave to Amend Invalidity Contentions" pp. 4-7, Sep. 21, 2009.

"Amendment Under 37 CFR 1.111 and Interview Summary Record," filed Oct. 14, 2009 in Reexamination of RE 39,909, U.S. Appl. No. 90/010,372.

Office Action in Ex Parte Reexamination of Re 39,909, U.S. Appl. No. 90/010,372, dated Aug. 14, 2009.

Office Action in Ex Parte Reexamination of RE 39,909, U.S. Appl. No. 90/010,372, dated Mar. 10, 2010.

Ex Parte Reexamination Advisory Action, mailed Jun. 2, 2010 in Reexamination of RE 39,909, U.S. Appl. No. 90/010,372.

* cited by examiner

TECHNIQUE FOR DETECTING TRACKING DEVICE TAMPERING USING AN AUXILIARY DEVICE

This application claims priority of U.S. Provisional Patent Application Ser. No. 61/104,576, entitled "Technique for Detecting Tracking Device Tampering", filed on Oct. 10, 2008 which is incorporated by reference herein. This application is also related to concurrently filed U.S. patent application Ser. No. 12/576,054, entitled "Technique for Detecting Tracking Device Tampering."

TECHNICAL FIELD

The various embodiments herein relate to a system and methodology for detecting tracking device tampering of the type wherein signal-shielding material is disposed around such devices so as to interfere with or obstruct their reception of location-determining signals. These tracking devices are typically used in a location tracking system wherein each tracking device provides its received signals or tracking device location signals derived therefrom to a remote monitoring center.

BACKGROUND OF THE INVENTION

In prior art location tracking systems, a tracking device provides its respective location, e.g., its latitude and longitude, or information from which such location can be determined, to a remote monitoring center. At the center, or some other associated place, the location of the tracking device is determined, if necessary, and then stored and/or processed. To this end, each tracking device receives signals from GPS satellites and/or wireless signals from terrestrial antennas, hereinafter "other wireless signals". Each tracking device is typically carried by an entity, hereinafter the "monitored entity", and there may be many different types of monitored entities, including but not limited to, an individual, a moving vehicle, a product, or a product container. The information stored at the remote monitoring center or some other associated location may be used to provide a history of the location of the tracking device and its associated entity as a function of time.

Each tracking device can be implemented as a unitary device, the so-called "one-piece" tracking device, or as multiple devices that communicate with one another. In either case, each tracking device contains a GPS and/or other wireless signal receiver for respectively receiving GPS signals from satellites or receiving other wireless signals. The signals received from such sources may be used to determine the location of the tracking device, such tracking device location determination being either within the device and/or at a remote location. A "dumb" tracking device is one that merely retransmits the received GPS or other wireless signal to a remote location wherein the location of the tracking device is derived from the received signals. A "smart" tracking device, on the other hand, possesses the capability of deriving its location from the received GPS or other wireless signals and subsequently transmits its determined location to a remote location. Such transmissions to the remote location are typically periodic to reduce consumption of the tracking device's internal battery, but can be immediate, if desired or if one or more prescribed "alarm" conditions are detected. Alarm conditions include, but are not limited to, detection of tracking device tampering, or a determination that the device is located in a prohibited zone, i.e., an "exclusion zone" or that the device is outside of a permitted zone, i.e., a "inclusion zone".

Such zones can be set individually to match the requirements for the monitored entity. Smart or dumb tracking devices can be "passive", "active" or a combination thereof. In the latter case, the tracking device communicates its location or its received GPS or wireless signals to an intermediary device, such as a docking station, which, in turn, transmits such signals via wired or wireless communications to the remote location. Active tracking devices have the capability of transmitting their location or their received GPS or wireless signals to the remote monitoring center.

Tracking devices can be used in a variety of applications in which persons may attempt to thwart or otherwise interfere with tracking device operation. One such application where this situation arises is where the tracking device along with a remote monitoring center is used to track the location of an "offender", i.e., an individual who are part of a governmental program, such as parole or the like, wherein monitoring of the offender's location is required. In such applications, the device is affixed to the offender and usually can not be removed by other than authorized persons. Any attempt by the offender or other non-authorized persons to remove the tracking device from the offender or to open the tracking device and disable its operation is detected and results in the transmission of an alarm signal to the remote monitoring station and thereupon appropriate action is taken. While existing tracking devices with tamper detection capability perform satisfactorily, they have certain limitations. For example, when the tracking device is in certain locations, such as being indoors, or in an urban area surrounded by tall buildings, or in a valley surrounded by mountains, hereinafter individually referred to as an "environmentally impaired location," its ability to receive GPS satellite signals and/or other wireless signals is significantly impaired so as to render the tracking device incapable of providing its normal functions. Moreover, street-savvy individuals have learned that they can mimic this situation by placing a metal foil or the like around the tracking device. At times, this intentional impairment is only for a time period when the offender intends to engage in prohibited activities. During such time period, the location of the offender is unavailable and after removal of the metal foil, the tracking device resumes its normal operation. As a result, there is the unresolved issue as to whether the tracking device was merely in an environmentally impaired location during the time period in which the location of the tracking device is not available or whether there has been tracking device tampering during this period. Moreover, this form of tampering is not limited to offender tracking systems and can also occur in other applications wherein one or more persons desire to thwart the tracking of the monitored entity. For example, some trucking companies that use GPS to track their vehicles have discovered that certain truck drivers wrap the GPS antenna of their truck tracking devices with shielding material to prevent the companies from tracking their truck's location. This above-described shortcoming of tracking devices to provide location tracking renders them incapable of meeting the desired system objectives of certain location tracking applications. Accordingly, it would be desirable if a mechanism could be devised to determine whether there has been tampering or merely a natural loss of signal reception due to the monitored entity being in an environmentally impaired location.

SUMMARY OF THE INVENTION

In accordance with the various embodiments herein, the limitations of prior tamper detection capabilities in a location tracking system are overcome through the use of an auxiliary signal-emitting device along with a tracking device for each monitored entity. Both the auxiliary device and the tracking device are in close proximity to one another and typically are affixed to or otherwise carried by the monitored entity. Accordingly, the tracking device should always be able to receive signals from the auxiliary device even when the tracking device is disposed in a location where its ability to receive signals from GPS satellites and/or other wireless signals is poor or non-existent. In accordance with the various embodiments herein, the auxiliary signal-emitting device transmits at least one signal to the tracking device that mimics the signal to the tracking device. At the tracking device or at some other location, the signal received by the tracking device from the auxiliary device, only or along with the signal received by the tracking device for determining the location of such device, is processed to form a tampering determination.

Advantageously, the various embodiments herein may be used in location tracking systems employing location tracking devices that are smart, dumb, active, or a combination of smart and passive location tracking devices, wherein the GPS signal receiving and processing capabilities of the tracking device are turned off so long as the tracking device is in communication with its home system or "docking" station.

DETAILED DESCRIPTION

Figure 1:
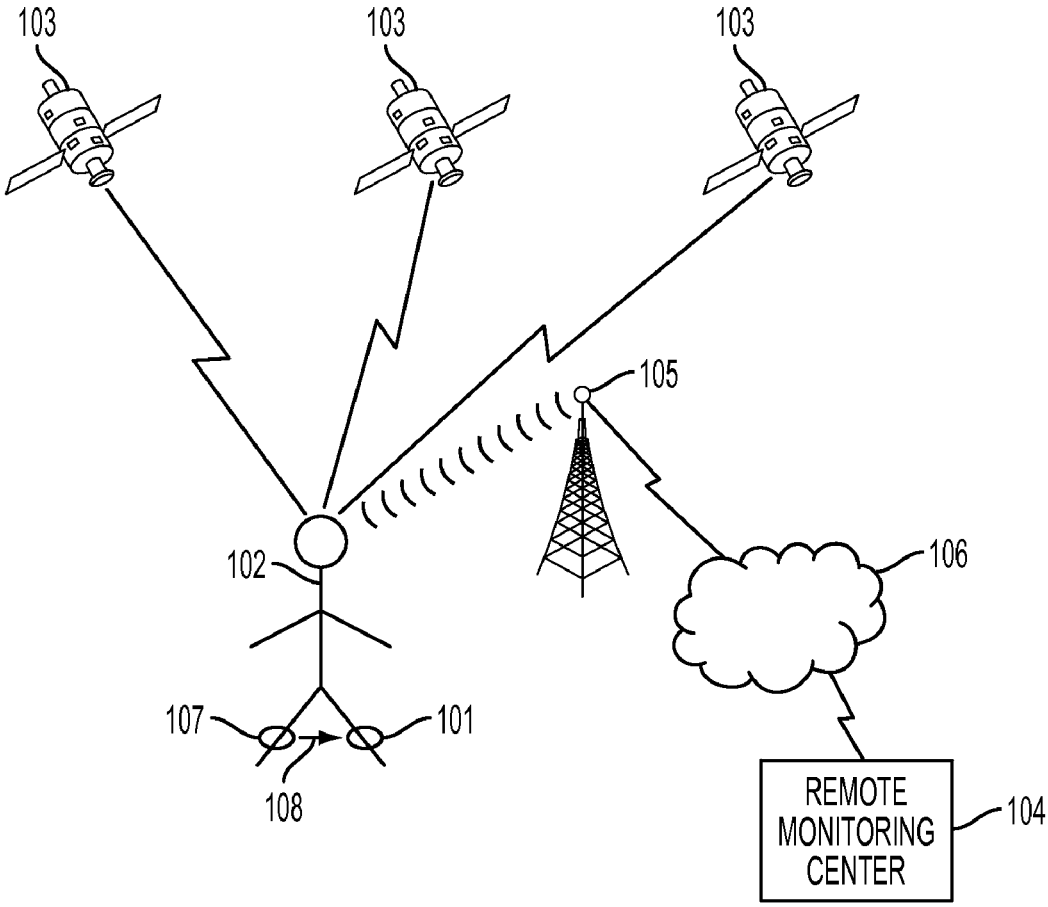
FIG. 1 is an exploded view of an illustrative offender tracking system including a tracking device, a remote monitoring station and an auxiliary signal transmitter in accordance with the various embodiments herein.

Referring now to FIG. 1 which illustrates an illustrative offender tracking system that incorporates the various embodiments herein. As shown, tracking device 101, illustratively implemented as a one-piece tracking device, is affixed to one ankle of offender 102. Auxiliary signal transmitter 107 is affixed to another ankle of offender 102. Tracking device 101 includes a GPS receiver for receiving signals from a plurality of satellites 103 and can determine its location, i.e., its latitude and longitude, using an on-board processor. Or, alternatively, tracking device 101 can simply retransmit such received signals to a remote location, such as center 104, wherein the latitude and longitude of device 101 is determined. Tracking device 101 may also receive other wireless signals, such a cellular signal received from a plurality of cellular signal towers 105, only one of which is shown in FIG. 1, to determine its location. Such other wireless signals are used to provide a back-up mechanism for determining the location of tracking device 101 when such device is disposed in a location where GPS signal reception does not meet a predetermined criteria, such as when tracking device is in an indoor location. Or, the use of GPS and other wireless signals may be used together to provide tracking of device 101 using a weighted average of such signals. All of the foregoing is known in the prior art. See, for example, U.S. Reissued Pat. No. 39,909, reissued Nov. 6, 2007, and U.S. Pat. No. 6,774,797, issued Aug. 10, 2004 which are incorporated herein by reference in their entirety.

Communication between tracking device 101 and remote center 104 is via wireless communications including illustrative signal receiving and transmitting tower 105 which is part of a conventional wireless communications system, such as a cellular telephone network, which may couple its signals directly to remote monitoring center 104. Or, as shown in FIG. 1, the wireless communications system may couple the signals received from tracking device 101 via a wired communications network 106 to remote monitoring center 104.

While tracking device 101 is shown in FIG. 1 as a one-piece device affixed to the ankle of offender 102, other limbs may be used. Moreover, tracking device need not be a one-piece piece device but can also be a multi-piece device, such as the two piece tracking device shown in U.S. Pat. No. 5,731,757, issued Mar. 24, 1998 or in U.S. Pat. No. 6,100,806, issued Aug. 8, 2000 which are also incorporated herein by reference. Finally, the various embodiments herein are not limited to use in tracking system which use active tracking devices but may also be used in systems which are a combination of passive and active systems.

Figure 4:
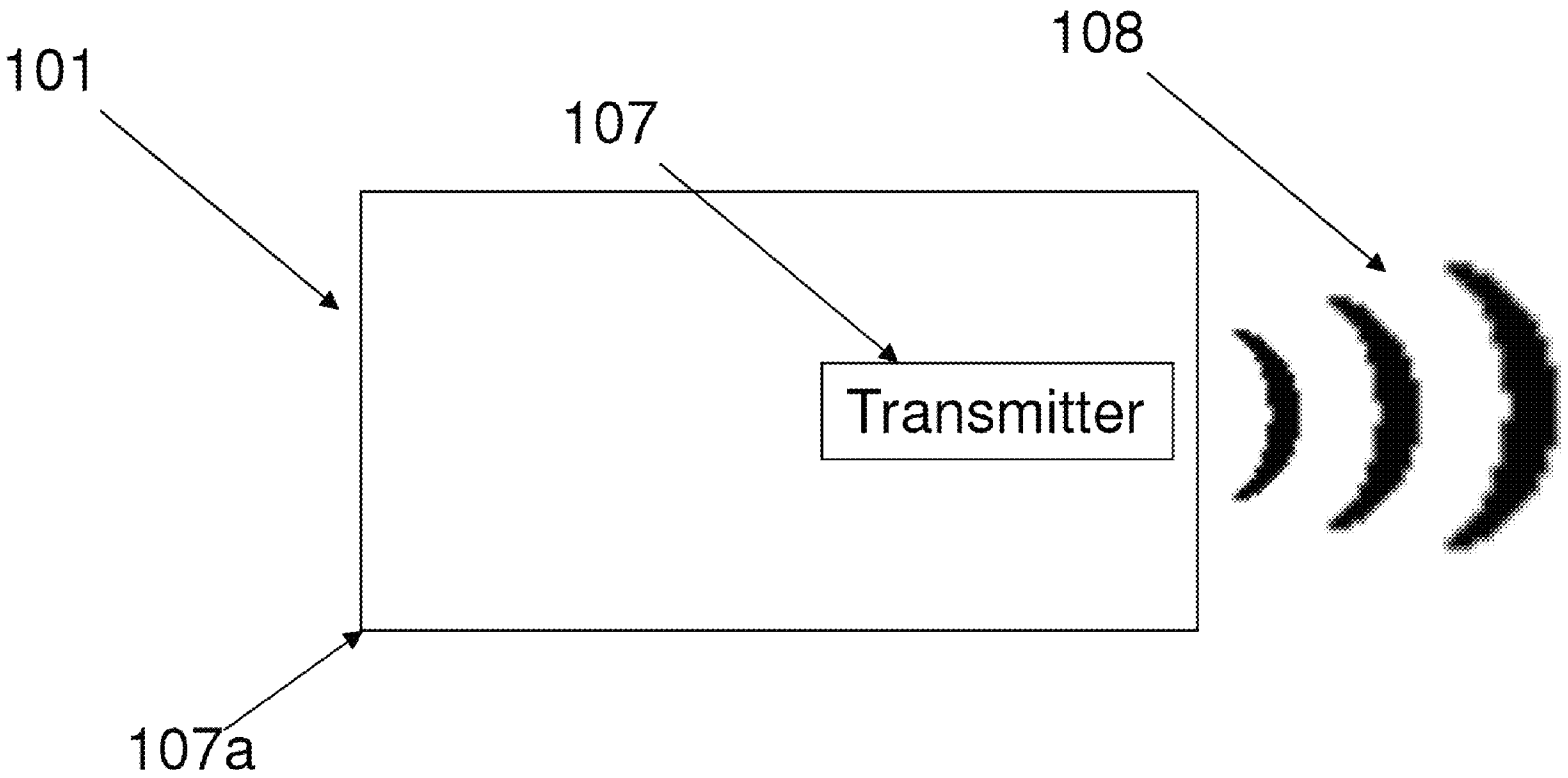
FIG. 4 is a black box drawings of a transmitter in accordance with an embodiment of the invention.

Now, in accordance with the various embodiments herein, an auxiliary signal transmitter 107 is also affixed to offender 102. Transmitter 107 transmits at least one predetermined low-power signal 108 that respectively mimics the characteristics of a corresponding signal received by tracking device 101 for purposes of determining its location. So, for example, when tracking device 101 solely receives GPS signals from satellites 103 for use in determining the location of tracking device 101, auxiliary transmitter 107 transmits a mimicking GPS signal. As is known in the prior art, tracking device 101 may also use wireless signals from terrestrial antennas, such as cellular, alone or in combination with GPS signals for determining the tracking device location. If so, transmitter 107, preferably includes a mimicking signal for each signal used by tracking device for determining its location. The characteristics of each mimicking signal transmitted by transmitter 107 is such that it may be reliably received and processed by the signal receiving apparatus disposed in tracking device 101 used for its location-determining counterpart. That is, the frequency and amplitude of each mimicking signal is within the permissible range of frequencies and received amplitudes for reliable reception and processing of its location-determining counterpart. In addition, preferably, the signals transmitted are encoded so that each auxiliary transmitter 107 is paired with a particular tracking device 101 and vice versa. The signal transmitted by transmitter 107 may also include an indication as to whether transmitter 107 is functioning properly or improperly and, further, may include an alarm signal indicating any attempt to tamper with the operation of transmitter 107. To this end, a tamper detection mechanism, such as detecting the severing of a strap securing the auxiliary transmitter 107 to the monitored entity, or whether the auxiliary device is in direct contact with the monitored entity, or detecting whether the housing 107*a* (FIG. 4) encompassing the circuitry within the auxiliary device has been altered may all be utilized in auxiliary device 107. In addition, such prior art tamper detection techniques may also be used in tracking device 101.

As will be described, auxiliary transmitter 107 provides a control signal or baseline with which the performance of tracking device 101 can be measured, much like a control group in a pharmaceutical study. In this regard, it should be appreciated that the GPS signal received by tracking device 101 may be attenuated when tracking device 101 is in the basement of a building, or in a subway. Similarly, this same attenuation may be present for other wireless signals when tracking device 101 is disposed in certain areas, as for example, when there is no nearby cellular tower. However, due to the close proximity of the auxiliary device to the tracking device, the signal transmitted by the auxiliary device should always be properly received even when the monitored entity is in a location where GPS satellite signal reception and/or terrestrial wireless signal reception is poor or nonexistent.

The various embodiments herein are intended to detect whether there has been tampering in the form of an attempt to obstruct the operation of tracking device 101 by interfering with its ability to receive GPS and/or other wireless signals by placing metal foil or the like around such tracking device 101 or just its signal-receiving antenna(s). As will be described, tracking device 101 incorporates additional functionality that permits it to evaluate and report on discrepancies with regard to the strength of the signals received by tracking device 101. In this regard, tracking device would incorporate the capability to store the received strengths of its received signals and time-stamp the date and time of such signal reception. This information can then be evaluated in the tracking device and the results communicated to remote monitoring center 104. Alternatively, the tracking device could simply forward this data to remote monitoring center 104 for evaluation therein.

The received signal evaluation process, whether it resides on the tracking device or the system's central computer, in accordance with one of the various embodiments herein will examine the strength of a signal received by the tracking device from the auxiliary device at different times and provide a tampering determination therefrom. Evaluation of the strength of the signal received from the auxiliary device can be provided in a number of known ways including examining the received signal power or examining the received signal amplitude. For illustrative purposes, the disclosed embodiments will use the latter evaluation. With either strength evaluation, the process of deciding whether or not there has been tampering must be able to differentiate between environmental impairment, i.e., the tracking device is disposed in a location wherein reception of the location-determining signal or signals at the tracking device is poor or nonexistent, and intentional blocking or shielding, i.e., the placement of metal foil or another signal interfering material around the tracking device and/or the auxiliary device.

Figure 2:
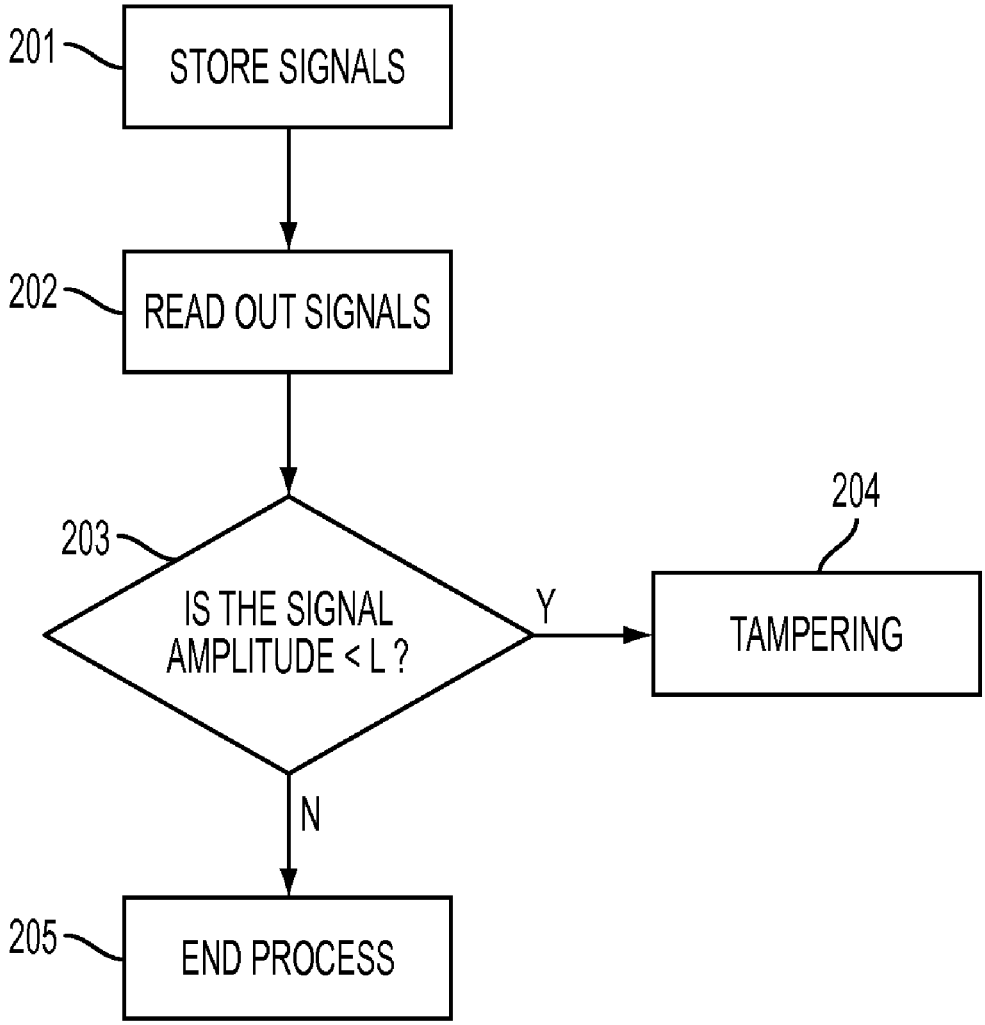
FIG. 2 is a flow chart of the steps used to detect tampering in the illustrative offender tracking system of FIG. 1 in accordance with one of the various embodiments herein.

Refer now to FIG. 2 which illustrates the evaluation process in accordance with a first embodiment of the various embodiments herein. It is assumed in this embodiment that the illustrative tracking device 101 utilizes GPS signals from satellites 103 to determine its location. Accordingly, auxiliary transmitter 107 transmits a mimicking GPS signal. This signal transmission may be continuous or non-continuous, e.g., periodic. Non-continuous transmission is deemed preferable as it reduces drain on the internal power source within the auxiliary device. At step 201, at each of a number of predetermined times, the signal amplitude of the GPS mimicking signal received from auxiliary device 108 at different times is stored and time stamped. At step 202, this signal is read out. At step 203, the amplitude level of the read out signal at the predetermined times is compared. If the compared amplitude of the mimicking signal at any time is less than a predetermined threshold, L, then a tampering result is provided at step 204 and stored. If not, the process ends at step 205. This process may be repeated, as desired, for mimicking GPS signals received by the tracking devices at later times. In certain applications, it may be preferable to provide a tampering result only if the amplitude of the received signal amplitude is less than the threshold L for some predetermined number of successive times. While this may slightly delay providing the tampering indication, having a repeated comparison of the received mimicking signal amplitude being less than the threshold lessens the possibility of providing an incorrect tampering indication. In addition, to add supporting evidence of tampering, it is preferable for certain tracking device applications that the auxiliary device and the tracking device each incorporate operational status monitoring wherein the proper operation of each device along with detected faults are stored and time-stamped. Accordingly, the determination of tampering via the above described monitoring of the amplitude of the GPS mimicking signal can be bolstered by operational status data of the auxiliary device and the tracking device indicating that both devices were operating properly at the time or at substantially the time that the amplitude of the received mimicking signal was less than the threshold T.

Figure 3:
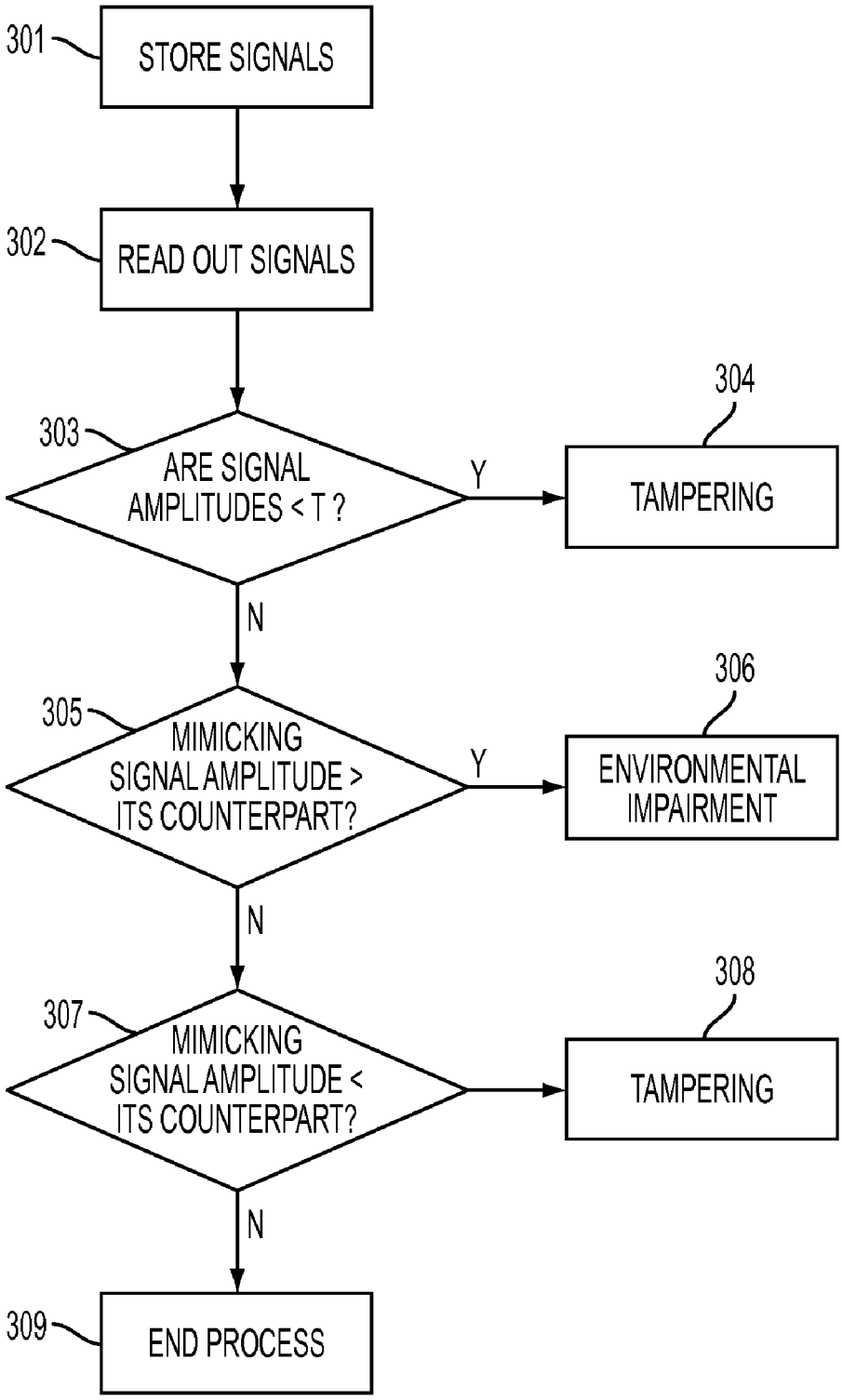
FIG. 3 is a flow chart of the of methodology used to detect tampering in the illustrative offender tracking system of FIG. 1 in accordance with another of the various embodiments herein.

Another methodology that may be used to detect tampering using the auxiliary device is shown in FIG. 3. Again, it will be assumed that the tracking device receives GPS signals from satellites from which the location of the tracking device is determined. As will be described, in lieu of monitoring just the amplitude level or received signal power of the GPS mimicking signal transmitted by the auxiliary device, the amplitude of this signal is compared to the amplitude of its location-determining GPS signal counterpart. In this methodology, the use of operational status data discussed in reference to FIG. 2 can also be utilized.

Refer now to FIG. 3. At step 301, at each of a number of predetermined times, the signal amplitude of the GPS mimicking signal received from the auxiliary device 108 and its GPS location-determining counterpart at each of a series of predetermined times is stored and time-stamped. At step 302, these signals are read out. At step 303, at each predetermined time, the received signal amplitude of the GPS mimicking signal and that of its location-determining counterpart are compared to a predetermined minimum threshold T. If both of these signal amplitudes are less than T, then a tampering result is provided at step 304 and stored. This tampering result at step 304 indicates that there has been tampering with operation of the tracking device and/or the auxiliary device via the use of shielding material. If at step 303, both of the signal amplitudes are not less than T, the process continues. At step 305, the amplitude of the mimicking signal is compared to that of its location-determining counterpart. If the mimicking signal amplitude is greater than its GPS location-determining counterpart by a first predetermined amount, then at step 306, an environmental impairment result is provided and stored indicating that the tracking device is disposed in a location wherein signal reception from GPS satellites is poor or nonexistent. If the mimicking signal amplitude is not greater than its GPS location-determining counterpart by the first predetermined amount at step 305, then the process proceeds to step 307. At step 307, the amplitude of the mimicking signal is compared to that of its location-determining GPS counterpart and if the former is less than the latter by a second predetermined amount, then a tampering result is provided at step 308 and stored. The aforesaid first and second predetermined amounts are determined empirically so as to provide valid tampering indications. At step 308, a tampering result indicates that there has been tampering in the form of signal shielding material disposed about the auxiliary device and/or its transmitting antenna. If, at step 307, the amplitude of the mimicking signal is not less than that of its location-determining GPS counterpart by the second predetermined amount, then the process proceeds to step 309 and ends. As with the steps shown in FIG. 2, the steps of FIG. 3 may be repeated as often as is desired.

In the foregoing description of FIGS. 2 and 3 it has been assumed that the tracking device receives GPS signals for determining the location of the tracking device. If the tracking device uses other wireless signals in lieu of the GPS signal, then the same methodology of FIGS. 2 and 3 can be used for this other wireless signal and the mimicking signal transmitted by the auxiliary device would mimic this other wireless signal. In addition, the various embodiments herein are also applicable for use in location tracking systems wherein the tracking device receives more than one signal to determine its location, such as in the case where GPS is the primary signal for determining the location of the tracking device, and another wireless signal is used as a fallback when GPS signal reception is poor, or nonexistent. In such case, the process of FIGS. 2 and 3 can be applied to whatever signal is being used for location determination at any time. The various embodiments herein can also be used in location tracking systems which utilize a combination of GPS and other wireless signal to determine the location of the tracking device, such as is disclosed in U.S. Pat. No. 6,774,797, issued Aug. 10, 2004, by carrying out the methodology of FIGS. 2 and 3 with respect to both signals that are used for location determination.

Additional complexity could be added to the disclosed tampering evaluation process, for instance, a cost model to more finely evaluate the degree of change and determine a tipping point where shielding has begun. The algorithm itself could also be configurable such that acceptable limits for both the control and GPS signal could be sent to the tracking device for use during its evaluation process. Intelligence could also be built into the algorithm or the evaluation limits to evaluate based upon the offender's historical tracking data (e.g., he/she works in an environment where there might be some level of interference even between the tracking unit and the control signal).

It is contemplated that the auxiliary transmitter may be worn or carried. While the auxiliary transmitter and tracking device have been described as being on different limbs, they could be disposed on the same limb or not necessarily on a limb but on the same part or on different parts of the offender's body. However, it is preferable that the auxiliary transmitter and tracking device be on different parts of the offender's body to make shielding of both devices more difficult.

It should, of course, be understood that while the various embodiments herein have been disclosed specifically, numerous alternatives will be apparent to those of ordinary skill in the art without departing from the spirit and scope of the various embodiments herein which can be implemented in other ways without departing from the spirit and scope of the various embodiments herein.

We claim:

1. A method of detecting tampering with the operation of a location tracking device, the location tracking device being of the type that receives first signals at different times from first sources that are remote from the location tracking device, the location tracking device generating data representative of the location of the tracking device at such different times from the received first signals, the method comprising the steps of:

transmitting a second signal at least one time, said second signal mimicking said first signals, said second signal being transmitted from a second signal source that is much closer to the location tracking device than said first sources;

receiving said second signal at said location tracking device; and processing said received second signal to determine whether there has been tampering with the ability of the location tracking device to receive said first signals.

2. The method of claim 1 wherein the location tracking device is attached to a monitored entity and the second signal is transmitted from an auxiliary device that is also attached to the monitored entity.

3. The method of claim 2 wherein the monitored entity is a person.

4. The method of claim 3 wherein the location tracking device is attached to a limb of the person and the auxiliary tracking device is attached to another limb of the person.

5. The method of claim 1 wherein the first signals are GPS signals and the second signal mimics these GPS signals.

6. The method of claim 1 wherein the first signals are terrestrial wireless signals and the second signal mimics these terrestrial wireless signals.

7. The method of claim 1 wherein the second signal has an amplitude and the processing of the received second signal involves comparing its amplitude to a threshold and generating a tampering signal when this comparison yields a certain result.

8. The method of claim 7 wherein the second signal is received by the location tracking device at more than one time and the processing of the received second signal involves comparing its amplitude at each such time to the threshold and the certain result is that this comparison yields the same outcome at least a predetermined number of times in a given time interval.

9. The method of claim 1 wherein the first signal and the second signal each have respective signal amplitudes, the second signal is received by said location tracking device at said different times and the processing includes comparing the amplitude of the first signal and the amplitude of the second signal at least one of said different times to a threshold, and providing a tampering signal based on this comparison.

10. The method of claim 9 wherein the processing also includes comparing the amplitude of the second signal to that of the first signal and the processing also provides said tampering signal based on this comparison.

11. The method of claim 10 wherein the processing provides said tampering signal if the comparison of the amplitude of the second signal to that of the first signal provides a repeated outcome at least a certain number of times within a predetermined time interval.

12. The method of claim 9 wherein the processing also includes comparing the amplitude of the second signal to that of the first signal and the processing also providing a signal indicating that the location tracking device is in an environment wherein reception of the first signals is impaired based on this comparison.

13. The method of claim 9 wherein the tampering signal is provided if the processing provides a repeated outcome at least a certain number of times in a predetermined time interval.

14. An apparatus configured for attachment to an entity having dimensions, said apparatus being configured to generate, and having a transmitter configured to transmit, an auxiliary signal that mimics certain characteristics of other signals from which a location can be determined, the auxiliary signal transmitted having a power level such that its transmission range is limited to the dimensions of the entity.

15. The apparatus of claim 14 wherein the other signals are GPS signals and the auxiliary signal mimics certain characteristics of such GPS signals.

16. The apparatus of claim 14 wherein the other signals are terrestrial wireless signals and the auxiliary signal mimics certain characteristics of the other signals.

17. The apparatus of claim 14 wherein the other signals are GPS signals and terrestrial wireless signals and the auxiliary signal mimics the GPS signals and the apparatus also transmits a second auxiliary signal that mimics the terrestrial wireless signals, the second auxiliary signal transmitted also having its power level limited such that the transmission range of the second auxiliary signal is also limited to said dimensions.

18. A method of detecting tampering with the operation of a location tracking device, comprising:

receiving at the tracking device first signals from first sources that are substantially remote from the location tracking device;

generating data representative of the location of the tracking device from the received first signals;

receiving a wireless second signal at the tracking device from a second source substantially proximate to the tracking device, the second signal mimicking at least one of the first signals;

determining based on the received second signal whether there has been tampering with an ability of the location tracking device to receive said first signals.

19. The method of claim 18, further comprising attaching the location tracking device and the second source to different parts of a monitored entity.

20. The method of claim 18, wherein the determining comprises considering an amplitude of the second signal.

21. The method of claim 18, wherein the determining comprises considering an amplitude of at least some of the first signals.

22. The method of claim 18, wherein the determining comprises considering an amplitude of the second signal and an amplitude of at least some of the first signals.

23. The method of claim 22, wherein the determining comprises considering the amplitude of the second signal relative to the amplitude of the at least some of the first signals.

24. An apparatus to assist in the detection of tampering with receipt of GPS signals, comprising:

an attachment shell configured for attachment to an entity;

a source of a data signal, the data signal mimicking certain characteristics of GPS signals;

a transmitter having a power level configured to transmit the data signal only within the immediate vicinity of the entity.

* * * * *